United States Patent [19]

Wassermann

[11] 4,242,955

[45] Jan. 6, 1981

[54] MAGNETICALLY ACTUATED EQUIPMENT

[75] Inventor: Carl I. Wassermann, Great Neck, N.Y.

[73] Assignee: North Atlantic Industries, Inc., Hauppauge, N.Y.

[21] Appl. No.: 887,293

[22] Filed: Mar. 13, 1978

[51] Int. Cl.[3] ..... B41J 9/38

[52] U.S. Cl. ..... 101/93.29; 101/93.48; 335/230; 335/234; 400/157.2

[58] Field of Search ..... 335/229, 230, 231, 234; 101/93.29, 93.30, 93.31, 93.48; 400/157.1, 157.2, 157.3, 157.4

[56] References Cited

U.S. PATENT DOCUMENTS

| | | | |
|---|---|---|---|
| 1,704,511 | 3/1929 | Nakken | 335/231 |
| 3,087,421 | 4/1963 | Irwin | 101/93.29 |
| 3,612,207 | 10/1971 | Cabanes et al. | 335/229 |
| 3,919,936 | 11/1975 | Barrus et al. | 400/157.2 |
| 4,014,258 | 3/1977 | Wassermann | 101/93.48 |
| 4,075,943 | 2/1978 | Johnston | 101/93.48 |
| 4,129,390 | 12/1978 | Bigelow et al. | 101/93.48 |

FOREIGN PATENT DOCUMENTS

| | | | |
|---|---|---|---|
| 152436 | 6/1904 | Fed. Rep. of Germany | 335/230 |
| 1514157 | 4/1969 | Fed. Rep. of Germany | 335/229 |

OTHER PUBLICATIONS

IBM Tech. Disc. Bulletin, vol. 20, No. 11B, Apr. 1978, (Bateson et al.), pp. 4686, 4687.

*Primary Examiner*—Clyde I. Coughenour
*Attorney, Agent, or Firm*—Charles H. Lindrooth

[57] ABSTRACT

Magnetically actuated impact equipment useful for high speed printers, punches or the like, is disclosed. Actuating magnets formed of materials characterized by wide hysteresis loops such as samarium-cobalt and mischmetal cobalt are disclosed. As disclosed, these magnets are oriented with like poles facing one another along opposite sides of gaps which run lengthwise of a print line. Magnetically actuated devices are shown with coils extending into the gaps with the plane of each coil being parallel to the print line. In one embodiment of the invention the magnets are arranged in upper and lower banks with coils on different movable devices extending upwardly and downwardly into gaps between the magnets in each bank. Another embodiment discloses coil-carrying devices which are mounted so as to be stepped along the gaps to various printing positions.

4 Claims, 8 Drawing Figures

Fig. 1.
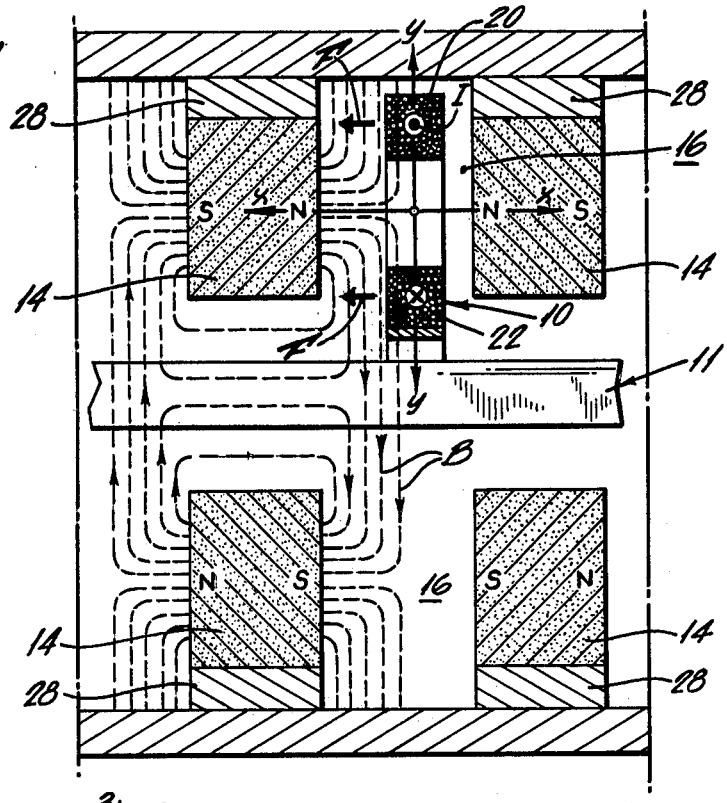
Fig. 2.
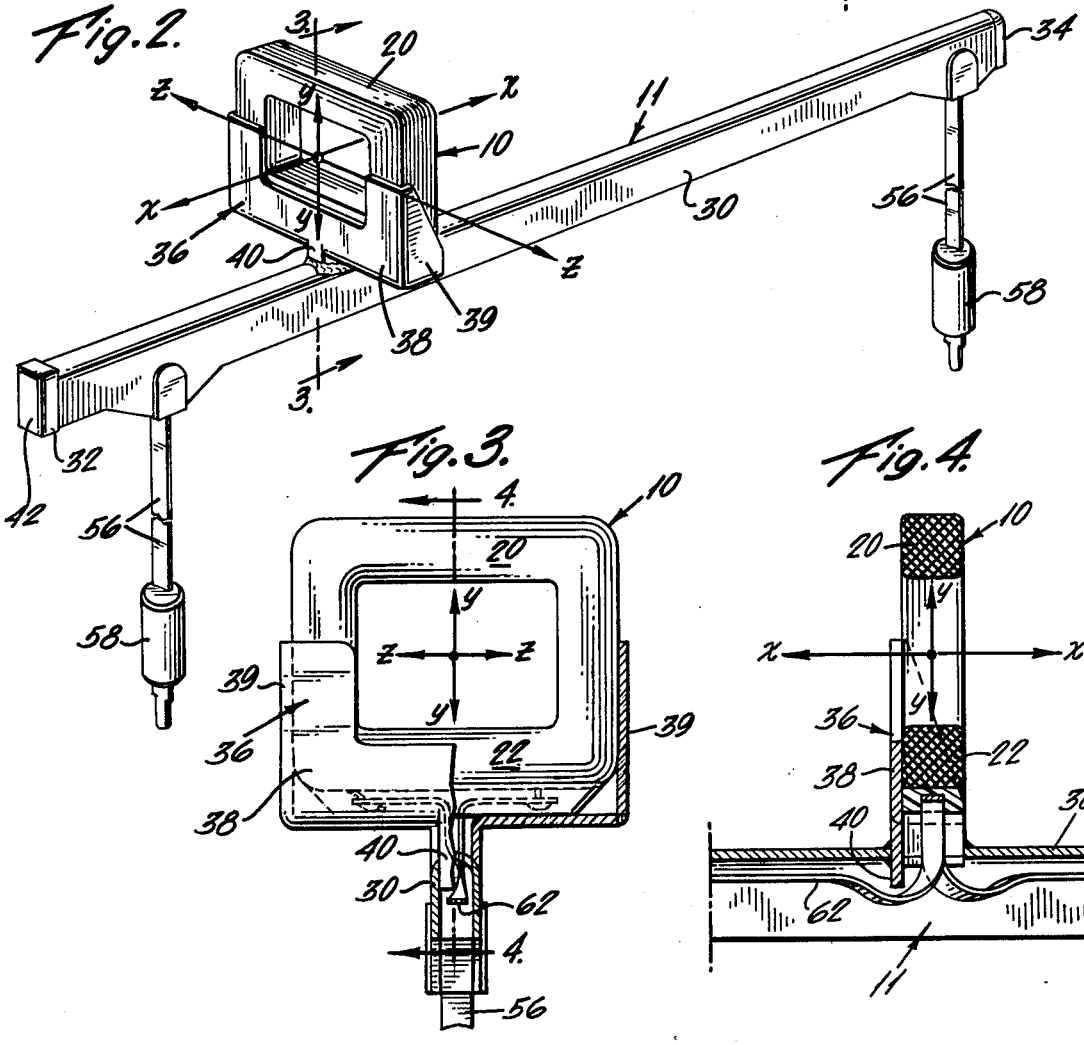
Fig. 3.
Fig. 4.
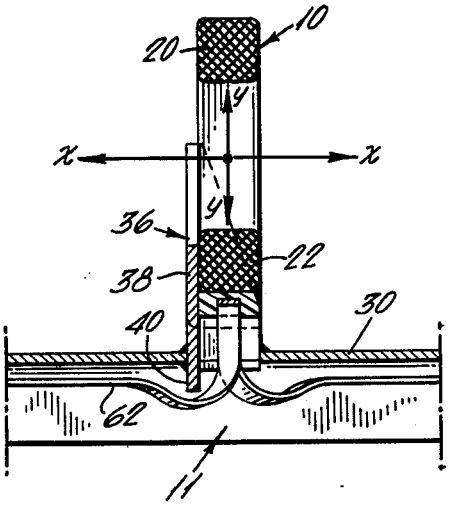

MAGNETICALLY ACTUATED EQUIPMENT

FIELD OF THE INVENTION

This invention relates to magnetically actuated impact devices especially suited for use in printers, punches, switches, or the like. More particularly, the invention relates to improvements in arrangement of magnetic actuating means for driving impact devices and to improvements in actuator construction.

Although in its broader aspects certain features of the invention have use in fields such as electromagnetic punches, switches, relays and other electromotive devices, the invention has particular applicability to high speed printers of the impact type.

BACKGROUND OF THE INVENTION

Magnetically actuated impact devices, especially those used as print hammers in high speed printers, are well known in the art. They utilize as their driving mechanism the deflective force experienced by a conductor when an electric current is passed through it while it is in the influence of an external magnetic field.

A conductive coil of particular cross-sectional configuration having n turns may be thought of as a series of n parallel conductive loops each of the same cross-section, aligned one with another in parallel planes along an axis which is normal to the planes in which the loops are disposed. Thus, for a coil of any cross-sectional configuration, the coil approximates a series of loops disposed in parallel planes. Thus, for example, a coil of rectangular cross-section having n turns can be visualized as a series of n parallel rectangular loops, each loop of which has two pairs of parallel legs. The plane in which the coil is wound for a coil of any cross-sectional configuration can be defined and used throughout this specification as the "coil plane". the axis about which the coil is wound is normal to the coil plane, and can be defined and used throughout this specification as the "coil axis".

Typically, conventional magnetically actuated impact devices attain a static magnetic field by means of stationary permanent magnets, or electro magnets, with opposite poles presented toward each other along an axis. These magnets are spaced apart from one another to provide a gap into which an impulse magnetic field generating means comprising a generally planar conductive coil is positioned for movement along a path parallel to the coil plane and for operative association with an impact member. The coil may be mounted directly on a one-piece impact member, or on one part of a multiple-piece impact member, so that displacement of the coil due to interaction of the static field with the impulse field when the coil is electrically excited is transferred directly into movement of the impact member toward a target. The coil may alternately be positioned to activate an interposer or split mechanism when electrically excited, so that movement of the impact member toward the target is effected indirectly by the coil. In the conventional actuation of impact devices, the static magnetic field component which interacts with the impulse magnetic field set up by the coil to cause coil displacement is the magnetic field component which is normal to the coil plane.

Development of magnetically actuated impact devices for use in the printer field is particularly troublesome because modern printing speeds of more than 2,000 lines per minute require, among other printing parameters, extremely rapid hammer travel time, low dwell time, and fast recovery time so that good print character resolution may be achieved.

Representative state-of-the-art magnetically actuated impact devices used as print hammers are disclosed in Helms, U.S. Pat. No. 3,172,352; Papadopoulous, U.S. Pat. No. 3,568,593; Lenders, et al, U.S. Pat. No. 3,735,698; and Wassermann, U.S. Pat. No. 4,014,258. These hammers are typically employed in side-by-side hammer arrays along a print line, wherein one coil is mounted on each hammer for selective activation by electrical current excitation of the coil. One print hammer may be provided for each print character position along the print line; or conventional space-sharing or time-sharing arrangements may be utilized so that one hammer services a plurality of print character positions.

Each of the above listed prior art references discloses a magnetically actuated impact device wherein a coil is supported on a movable impact member and positioned within a static magnetic field generated by means of paired permanent magnets. Passing an electric current through the coil induces an impulse magnetic field near the coil which interacts with the static magnetic field causing displacement of the coil and thereby the impact member toward the target. For each reference, the direction of travel of the coil is along a path parallel to the coil plane.

For a side-by-side print hammer array in the print hammer arrangements disclosed in Helms, Papadopoulous and Lenders et al, each coil is supported on its respective impact member with the coil axis parallel to the horizontal print line of the typed page. The coil plane in such configurations is perpendicular to the printed page with the active legs of the coil being those legs which are parallel to the page but perpendicular to the print line. Thus, by application of the right hand rule, the impact members are driven towards the page. In the side-by-side print hammer configuration of the type disclosed in the above identified Wassermann patent, the coil plane is also perpendicular to the printed page, but the coil axis is perpendicular to the horizontal print line of the page and the active coil legs are those which are parallel to the horizontal print line.

Because typical printer output is ten or more print characters per inch, magnetically actuated impact device design for side-by-side deployment in printers is subject to severe space limitations. The necessary packing densities in printers of the type disclosed in Helms are achieved by very thin coils fitted within narrow gaps between adjacent magnets. The number of turns in such coils is necessarily limited and clearance between the sides of the coils and the surfaces of the magnets is nominal. One common configuration employs wire which is flat in the coil plane as a means to conserve space. The very thin coils are relatively expensive to manufacture and considerable care and accuracy is required in assembly of such printers in achieving proper alignment of the coils within the narrow gaps. Further, the removal of the heat that builds up when the coils are repeatedly energized during high speed operation becomes a significant problem in closely packed designs. The geometry of these arrangements does not permit side stepping or column sharing of hammers unless the field generating means is moved as well.

SUMMARY OF THE INVENTION

Certain advantageous arrangements of the invention arise because of recent developments in permanent magnet materials, particularly the utilization of rare earth metal compositions. Permanent magnets made from these compositions have an unusually high resistance to demagnetization. Because of this characteristic, magnet circuit configurations may be employed which heretofore have not been considered because of the extremely high demagnetization influences associated with the configurations. More specifically, the novel configurations of a preferred form of the invention take advantage of the flux amplification phenomenon which arises when like magnetic poles are faced toward each other across a gap. An advantage of the arrangement is that large flux densities are available within the gaps in which the coils are placed. In a printer, this means that the coils may be located in wider gaps without sacrifice of printer speed. The wider gaps simplify the cooling problems associated with some prior designs and permit the use of relatively inexpensive coil designs.

According to the invention, means for establishing a static magnetic field and means for establishing an impulse magnetic field are supported for relative movement of one with respect to and in the magnetic field of the other. The means for establishing the impulse magnetic field comprises a generally planar electrically excitable coil which is positioned within the static field so that excitation of the coil effects motion of the movable magnetic means in accordance with the well known right hand rule substantially transversely of the coil plane. An impact member is operatively associated with each movable magnetic means to effect impact against a desired target upon electrical excitation of the coil.

Significant advantages of the invention arise out of the relative orientation of and the interaction of the static magnetic field generating means with the impulse magnetic field generating means.

Although the static magnetic field generating means may be movably supported in operative association with the impact member, with the coil supported in a stationary position, it is preferred to movably support the coil in association with the impact member and maintain the static magnetic means in fixed position. The coil is preferably positioned on a one-piece impact member or as part of a multiple-pieced impact member to effect movement directly thereto; the coil may alternatively be supported by an interposer or split mechanism to indirectly effect movement of the impact member.

In a preferred embodiment of the invention, the means for establishing a static magnetic field comprises pairs of magnets, such as permanent magnets, supported in a stationary position and axially from one another, with like poles presented towards each other across gaps which are formed therebetween. The means for establishing an impulse magnetic field comprises generally planar conductive coils supported within said gaps with each coil plane being substantially transverse to the axis of displacement of the magnets and mounted on impact members for movement therewith along a path transverse to the coil planes.

According to one aspect of the invention, the impact devices may be print hammers for use in high speed printer mechanisms wherein each coil is supported on an impact member which is mounted on a biasing support for reciprocal movement in a direction substantially transverse to the coil plane.

A preferred means for generating the static magnetic field in a print hammer embodiment comprises one or more pairs of permanent magnets axially displaced from one another on a keeper plate with like poles presented toward each other on parallel planar magnet surfaces across gaps. Drive coils are positioned within the gaps so that the coil planes are substantially parallel to the facing magnet surfaces. The coils are mounted on impact members disposed on the side of the permanent magnet pair away from the keeper plate, so that the coil plane is substantially normal to the direction of movement of the impact member. One advantage of the foregoing is that the hammers may be mounted for stepwise movement lengthwise of the gaps so that each hammer may serve a multiplicity of print positions. Alternatively, if one hammer is to be provided for each print position, one or more pairs of permanent magnets may be mounted on a second keeper plate and spaced apart with like poles presented toward each other across second gaps which are substantially in alignment with the first gaps. The poles of these pairs are disposed so that they are of opposite polarity to the poles of the first pairs. The gaps receive coils which are mounted on other impact members which preferably lie in the same plane as the first mentioned impact members. The second keeper plate is disposed on the side of second permanent magnet pairs away from the impact members. This latter arrangement improves the symmetry of the static magnetic field and permits increases in packing density.

An important feature of the first magnetic field generating means of the illustrative embodiment is that the spacing of a magnet pair with like poles facing each other generates a resultant static magnetic field having portions extending in a direction essentially perpendicular to the axis on which the magnets are displaced for all points in the gap away from the magnet surfaces. Furthermore, an amplification effect increases the density of this magnetic field as the width of the gap decreases. For gap widths which are appreciably larger than the gap widths available in the prior art discussed above, extremely high density magnetic fields are available to act on a conducting coil placed in the gap. For the illustrated embodiment, the useful component of direction of the static magnetic field is the component parallel to the coil plane, as compared to prior art devices in which gaps are bordered by opposite magnetic poles and the useful static magnetic field component is the component normal to the coil plane. The preferred orientation of the coil within the gap in the illustrated embodiment is parallel to the magnet surfaces to maximize the flux density component of the static magnetic field which is parallel to the coil plane.

Although some of the objects of the invention can be achieved by use of other permanent or electromagnets, permanent magnets made of rare earth metal materials such as samarium cobalt and mischmetal are preferred because of their wide hysteresis curves, excellent resistance to the demagnetization influences of opposing fields, and stability of the resulting field.

To maintain minimum mass, without sacrifice of strength and rigidity, in the embodiment more fully described later, the impact member is preferably made of an aluminum or magnesium channel, with a tip and backstop portion made of a high impact strength molded plastic or like material integrated into the channel. A steel or other hard material impact surface is embedded in the tip portion. The impact member may be mounted for reciprocating movement on biasing members, such as a conductive spring support. The conductive spring support can serve as a circuit to carry electrical current to the coil.

A preferred embodiment includes a plurality of permanent magnets, set apart in spaced relationship to one another with like poles presented toward each other on parallel planar magnet surfaces across a first series of parallel gaps. In the preferred embodiment, these magnets are held in stationary position by supporting structure at one side of the magnets. Within each gap is positioned one or more coils each mounted on an impact member of the type described above. Coils of adjacent impact members can be distributed in stepwise sequence in the gaps of the gap series. When the sequence has stepped to where a coil is positioned in the last gap, the sequence can begin again for a plurality of coils positioned in each gap.

In a preferred printer array embodiment, a plurality of coils, each mounted for reciprocal movement on an impact member, can now be positioned in each gap pair, with adjacent coils extending alternatively up into the first series of gaps and down into the second series of gaps to provide greater packing density. Arranging the magnets so that the gaps run the length of the print hammer array provides convenient relatively large channels for cooling the assembly.

OBJECTS OF THE INVENTION

An important object of the invention is the provision of a magnetically actuated impact device which incorporates the improvements set out above.

Another object of the invention is to provide a coil driven actuator wherein the static magnetic field is substantially parallel to the coil plane.

A related object to the invention is to provide a coil driven actuator in which the interaction of the static magnetic field with the impulse magnetic field drives the coil in a direction generally transverse to the coil plane.

Another object of the invention is the use in the operation of a magnetically actuated impact device of a principle of magnetic field generation wherein an amplification of flux densities is produced.

A related object of the invention is the provision of a print hammer embodiment for use in a side-by-side hammer array in printers which permits high packing densities and facilitates the removal of heat.

A further object of the invention is the use of magnetic materials to provide a magnetic field generating means for a magnetically actuated impact device wherein permanent magnets are set apart in spaced relationship to form gaps having like poles facing each other across the gaps.

A related object of the invention is to provide a print hammer embodiment which offers greater reliability and leads to a reduction in production and operating costs.

A further object of the invention is to provide a coil driven print hammer which more efficiently utilizes the magnetic flux of the surrounding static magnetic field.

A still further object of the invention involves the use of permanent magnets preferably made from rare earth metal compositions wherein surfaces of like polarity are disposed across gaps within which coils for actuator devices are positioned and wherein the external magnetic field is essentially parallel to the coil plane.

Another object of the invention is the provision of a magnet arrangement wherein gaps of uniform flux density extend lengthwise of a plurality of print positions whereby hammer stepping is facilitated.

A related objective is the provision of magnet gaps extending between static field generating means and running lengthwise of a plurality of print positions whereby hammers may be stepped to different positions without movement of the static field generating means.

The foregoing and other objects and advantages of the invention will become apparent upon reference to the following detailed description of one preferred embodiment of the invention, as illustrated in the accompanying drawings, in which:

BRIEF DESCRIPTION OF THE DRAWINGS

FIG. 1 is a schematic view illustrating the relationship between the static magnetic field and the coil, and the principle of operation of the present invention, as used in an illustrative print hammer device;

FIG. 2 is a perspective view of a print hammer incorporating features of the present invention;

FIG. 3 is a sectional view taken along line 3—3 of FIG. 2, with certain portions omitted and cutaways provided to illustrate construction and arrangement of the device of FIG. 2;

FIG. 4 is a sectional view, taken along line 4—4 of FIG. 3, omitting certain structural portions;

DESCRIPTION OF A PREFERRED EMBODIMENT

Figure 5:
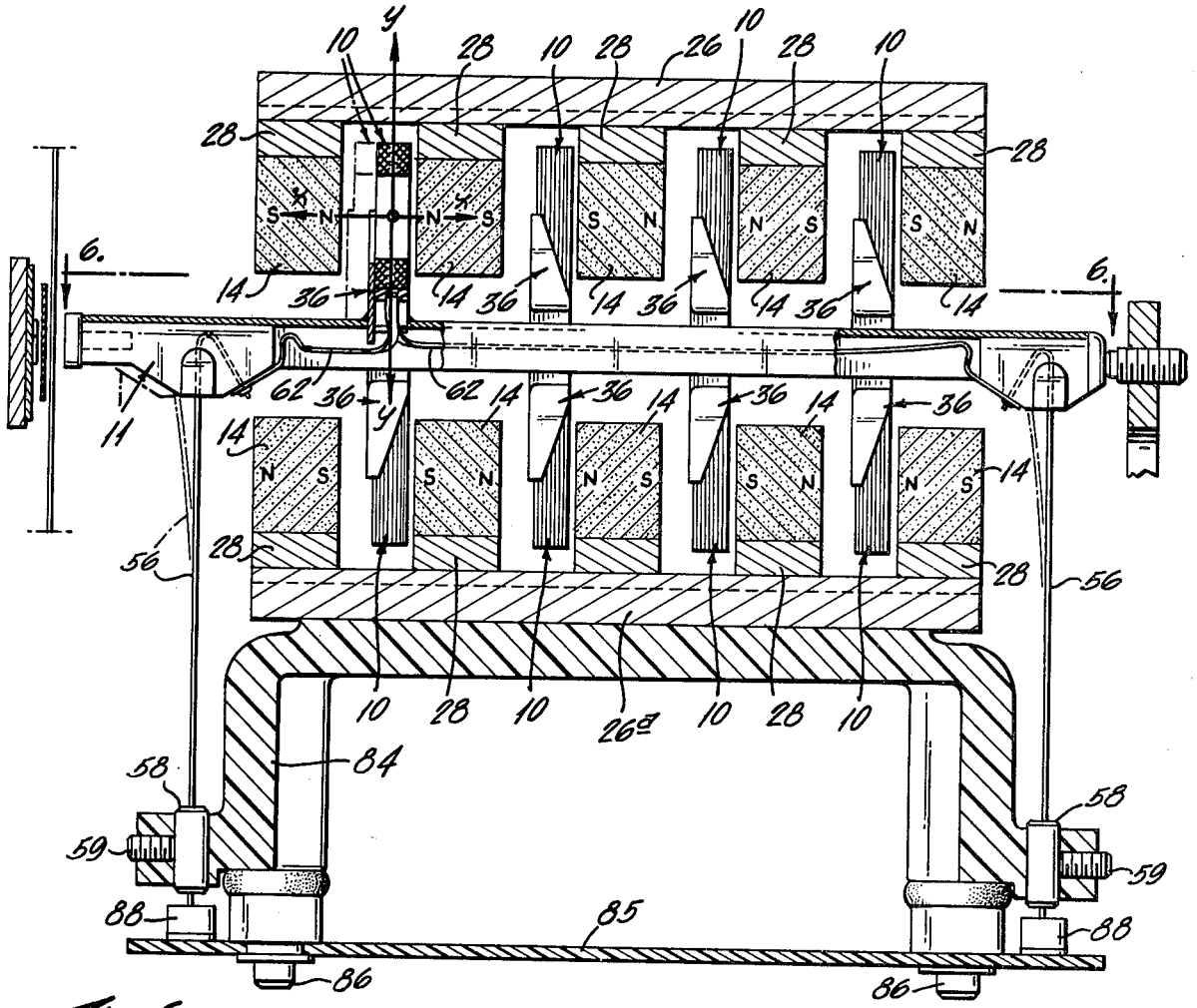
FIG. 5 is an elevation view illustrating an integrated print hammer array/magnet assembly, and shown partially in section to portray some of the features of the invention.

For purposes of illustration, the invention in its preferred form is embodied in a high speed printer, such as a back printer having an alphanumeric type font carrier such as moving endless belt or drum. The coil of each of a plurality of print hammers is electrically impulsed to drive the energized print hammer against an ink ribbon and paper, and into a type font at the exact moment when the desired type character to be printed is positioned behind the paper at a given hammer location.

The principle that a current carrying conductor immersed in an external magnetic field will experience a deflecting force at right angles to the field and the axis of the conductor is well established in the science of electromagnetism and is applied in innumerable devices. In brief, the resultant force F exerted on a straight wire of length L, carrying current I and placed in an external magnetic field B perpendicular to the wire, may generally be expressed as $F=IL\times B$; where the resultant force has a magnitude ILB and points in a direction determined by application of the familiar right-hand rule.

This principle is applied in the current invention, as illustrated schematically in FIG. 1.

In the schematic of FIG. 1, a conductive coil 10 having n turns is shown in section. The coil 10 is carried on a member 11 more particularly described hereinafter.

The member 11 positions the coil 10 within a static magnetic field represented by lines of force B. Although other means of generating the field may be employed, I prefer to use pairs of permanent magnets 14 formed of a rare earth metal composition such as samarium cobalt or mischmetal cobalt. FIG. 1 shows two pairs of magnets, one spaced above the other. The magnets of each pair are spaced apart to form a gap 16 within which a coil 10 is positioned by a support member 11. A second coil is intended to be located within the gap formed between the second pair of magnets but this coil is omitted for clarity of illustration. The omitted coil is suspended from another support member which is in aligned parallel relation with member 11 and therefore not visible in FIG. 1. It can be seen that the part of the field in which the coil 10 is located extends substantially parallel to the coil plane. This is accomplished in FIG. 1 by positioning the magnets in pairs with like poles facing each other across each gap 16 so that substantial portions of the field are directed in opposite directions along the Y-axis as viewed in The Figure. Further, each conductive coil is positioned within the gap in the portions of the field just mentioned.

The coils 10 are preferably formed in a substantially rectangular configuration so that each coil may be viewed as having oppositely disposed legs or sections 20 and 22 which extend substantially normal to the magnetic field. As shown in FIG. 1, the field portions in which the upper and lower or active coil legs are positioned, extend in directions essentially parallel to the coil plane. Still further, the field extends in a direction through the leg 20 which is opposite to the direction in which it extends through leg 22. When a pulse is applied to the coil so that current flows in the leg 20 normal to and out of the plane of the paper and normal to and into the plane of the paper in the leg 22, both the upper and lower legs 20 and 22 of the coil 10 experience a deflection force, represented by arrow F, to move the coil in a direction along the coil X-axis towards the left as viewed in FIG. 1 and having magnitude $F=nILB$ where n is the number of turns in the coil, I is the current flowing in each turn, L is the length of upper and lower legs and B is the average density of the magnetic field in which the upper and lower legs are located. The total force exerted on the coil 10 is thus 2F.

It is pointed out that even though the coils are illustrated as being positioned so that they lie in the Y-Z plane, parallel to the surfaces forming the gaps between magnets 14, and perpendicular to the axis along which the members on which they are mounted move, it should be understood that the coils may be disposed at an angle with respect to the Y-Z plane without departing from the principles of the invention. With the coil extending transversely of the axis along which the magnets forming a gap are displaced, so long as the field produced by the magnets produces a deflecting force in both legs of the coil to drive the support toward the left as viewed in FIG. 1, the objectives of the invention will be achieved. In this connection, wherein the term transversely is used in this specification with respect to orientation of the coil plane relative to the axis along which the magnets are displaced or relative to the axis along which the hammer moves, the meaning intended is that the coil plane is lying or placed across the axis without regard to the angle between the axis and the plane. The angle will in general be close to 90° in a configuration wherein the surfaces of the magnets forming the sides of the gaps are generally flat, but a variation of the angle will not influence the operation so long as the field generates a force extending in the requisite direction and there is adequate room between the magnets for the coil to move the necessary distance.

As indicated, the coils are mounted on movable support members 11, which in the illustrative embodiment are print hammers, one of which is shown in FIG. 2. By interaction of the static magnetic field 12 with the impulse magnetic field induced in the coil when the current I is passed through it as described above, the energized coil 10 and the hammer or impact member 11 is driven axially, that is, in a direction transverse to the coil plane so that the hammer is caused to impact against a print medium to cause a character to be printed on the medium.

The gap or spacing of each pair of permanent magnets 14 is wide enough to accommodate the thickness of a coil 10 plus the desired length of hammer stroke from start position to impact.

The magnet pairs 14 are preferably supported on keepers 26 formed of ferromagnetic material. Although the use of keepers is not essential to the practice of the invention, their use serves to confine the field in the region above and below the magnet assemblies and also results in some increase in flux densities within the gaps. Plates of aluminum alloy or other non-magnetic material are provided as spacers 28 to permit location of the coils in relation to the magnets with the coil legs substantially in line with the outer edges of the magnets, where the flux density is found to be greatest. The preferred relation is illustrated in FIG. 1 wherein the center of the upper active coil leg 20 and the center of the lower active coil leg 22 are in substantial alignment with the top and bottom edges respectively, of the facing magnet surfaces.

The like pole configuration illustrated in FIG. 1 produces a change in field direction and a magnetic flux amplification effect, thereby providing large magnetic flux densities B in the gap areas in which the conductors are located. Thus, wide gaps with large flux densities can be used. Since the magnitude of the deflecting force F is directly proportional to current I and magnetic field density B, raising the value of B permits the use of lower values of current. A reduction in $I^2R$ heating is thus achieved. It can be seen that this configuration provides for much more design flexibility than has been possible with prior approaches.

An important criterion in the selection of the magnet materials utilized in the configuration illustrated in FIG. 1 is their ability to withstand the high demagnetization influences of this arrangement. Materials especially suited for this magnetic field generating means configuration include rare earth metal compositions such as samarium-cobalt and mischmetal cobalt, and to a lesser extent sintered ceramic materials. Such materials are characterized by wide hysteresis loops as compared with hysteresis loops of conventional magnetic materials such as Alnico although for some applications, such as in low speed devices even Alnico may be used. Samarium-cobalt is selected as a preferred material for use in the illustrative high speed print hammer application because of its high flux density and excellent resistance to demagnetization when magnets of like polarity are forced into close proximity.

As stated, it has been measured that the magnetic flux in the Y-Z plane inside the gap is greatest adjacent the upper and lower peripheries of a magnet pair. By way of example, a pair of samarium-cobalt magnets spaced one-third of an inch apart and having a width in the Y-axis direction of 0.4 inches, and a length along the Z-axis long enough so that in the area of measurement the magnets are continuous or infinite, provide magnetic fields of approximately 4,000 gauss at the upper and lower peripheries of the facing surfaces of the magnets 14 near the keeper surfaces. Measurements taken along the X-axis direction in the gap 16 show little difference in magnetic field across the width of the gap 16, for all distances far enough away from the magnet surfaces so that surface and edge effects are negligible.

Thus, when using a substantially rectangular coil, positioning the coil with the center of the upper leg 20 substantially level with the upper periphery of the facing surfaces of the magnets 14 and the center line of the lower leg 22 substantially level with the lower periphery of the facing surfaces of the magnets, and keeping the coil from immediate contact with the magnet surfaces, places the coil legs in the densest portion of the field. At these points the field is essentially parallel to the coil plane and extends in opposite directions through the coil legs as can be seen upon reference to the directional arrows B in FIG. 1.

FIG. 2 shows a preferred form of coil carrying impact member 11 useful for carrying out the principles of the invention. The impact member 11 comprises an elongated shank 30, preferably constructed of a lightweight non-magnetic material such as aluminum, magnesium or the like. The shank 30 has a tip 32 at one end formed of molded plastic in which a high impact resistant insert 42, made for example of steel, is provided. A second tip 34 is located at the opposite end of the shank 30. Tips 32 and 34 are preferably made of a material such as a glass filled polycarbonate resin suitably attached to the shank 30 by means of a bonding agent.

In order to minimize mass without sacrifice of rigidity, the shank 30 is formed as a channel having a substantially U-shaped configuration as shown in section in FIG. 3. The coil 10 is connected to the shank 30 by means of a saddle 36. Saddle 36 is formed of a generally U-shaped front and bottom wall portion 38, side walls 39 and a tab 40 which fits into a slot within the channel-shaped shank. The coil 10 fits within the front and side walls of the saddle so as to protect the coil from the forces associated with the impact and rapid changes of momentum experienced by the shank during hammer operation. After mounting of the saddle on the shank, the assembly is preferably dip-brazed to provide a strong integrated structure which is resistant to bending and which is able to rigidly hold the coil in position on the shank.

Preferably, each impact member 11 is supported for movement along its longitudinal axis on pairs of flexure members such as flat springs 56 (FIG. 5). To provide a current path for electrically impulsing the coils, the springs may be formed of electrically conductive material, preferably non-magnetic beryllium copper alloy or stainless steel. The electrical impulsing means further comprises conductors 62 which interconnect the ends of the spring supports to the coil leads.

Figure 6:
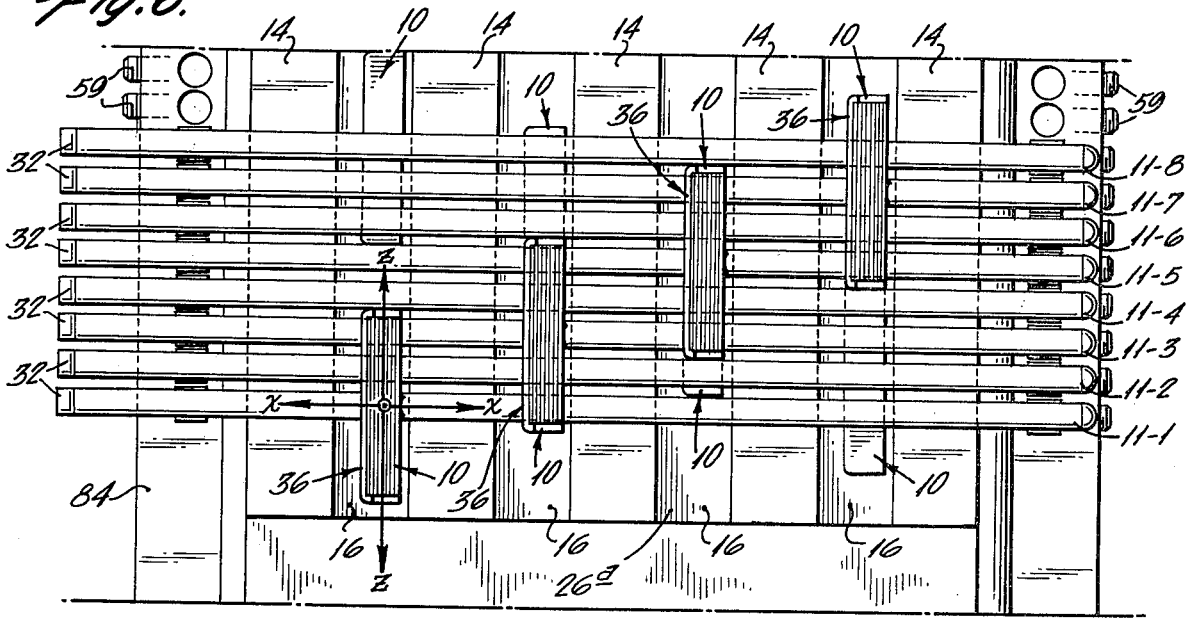
FIG. 6 is a plan view of the array of FIG. 5 taken along the line 6—6.

Reference is now made to FIGS. 5 and 6, wherein the principles discussed above are incorporated into a line printer having hammers located in side-by-side relationship. Each of the hammers, identified by the reference character 11, is of the configuration shown in FIGS. 2 through 4. In FIGS. 5 and 6 a first or lower group of magnets 14 is supported on spacers 28 which are in turn mounted on lower keeper plate 26. In the embodiment of FIGS. 5 and 6 the magnets are spaced apart so that four lower gaps extending transversely of the hammer array are provided within which coils suspended from the impact members 11 are located.

Lower keeper plate 26a is mounted on support member 84 formed of a non-magnetic material. The support member 84 is bolted to the machine frame 85 by fasteners 86. The support member also provides support for the spring supports for each of the hammers. As particularly illustrated in FIG. 5, ferrules 58 are secured within holes in the support member by set screws 59. The ends of the support springs 56 extend below the ferrules 58 into electrical connectors 88 which are mounted on the machine frame and lead to control circuitry not shown.

Located in spaced relationship above the first set of magnets is a second set of magnets 14 which is mounted on a second keeper plate 26 by means of spacers 28, as just described. The second group of magnets should be positioned relative to the first group so that the gaps of the second group are in substantial alignment with the gaps of the first group to present gap pairs. Further, as is illustrated in FIG. 5 the surfaces which define the gaps of the first group of magnets in any gap pair are of opposite polarity to the surfaces defining the gaps just above them in the second group.

Eight hammers are disclosed in FIG. 6 for the purposes of illustrating a pattern in which the coils are preferably mounted on the hammers. In FIG. 6 the hammers are identified by the reference numbers 11-1 through 11-8. The coils on hammers 11-1, 3, 5 and 7 extend upwardly from the hammers into the gaps between the upper or second group of magnets, whereas the coils on hammers 11-2, 4, 6 and 8 extend downwardly into the gaps into the lower or first group of magnets. This pattern lends itself well to close packing and will repeat itself several times in the hammer array for a typical line printer so that the gaps between magnets will each be occupied by several laterally displaced coils.

The arrangement described above permits a compact spacing of hammers without interference between coils. A compact array can be achieved which allows for ample clearance of the coils in the gaps. Relatively large coils which are easily wound with a large number of turns can be employed. Heat can be easily dissipated from the assembly by circulating air down the channels or gaps 16.

Figure 7:
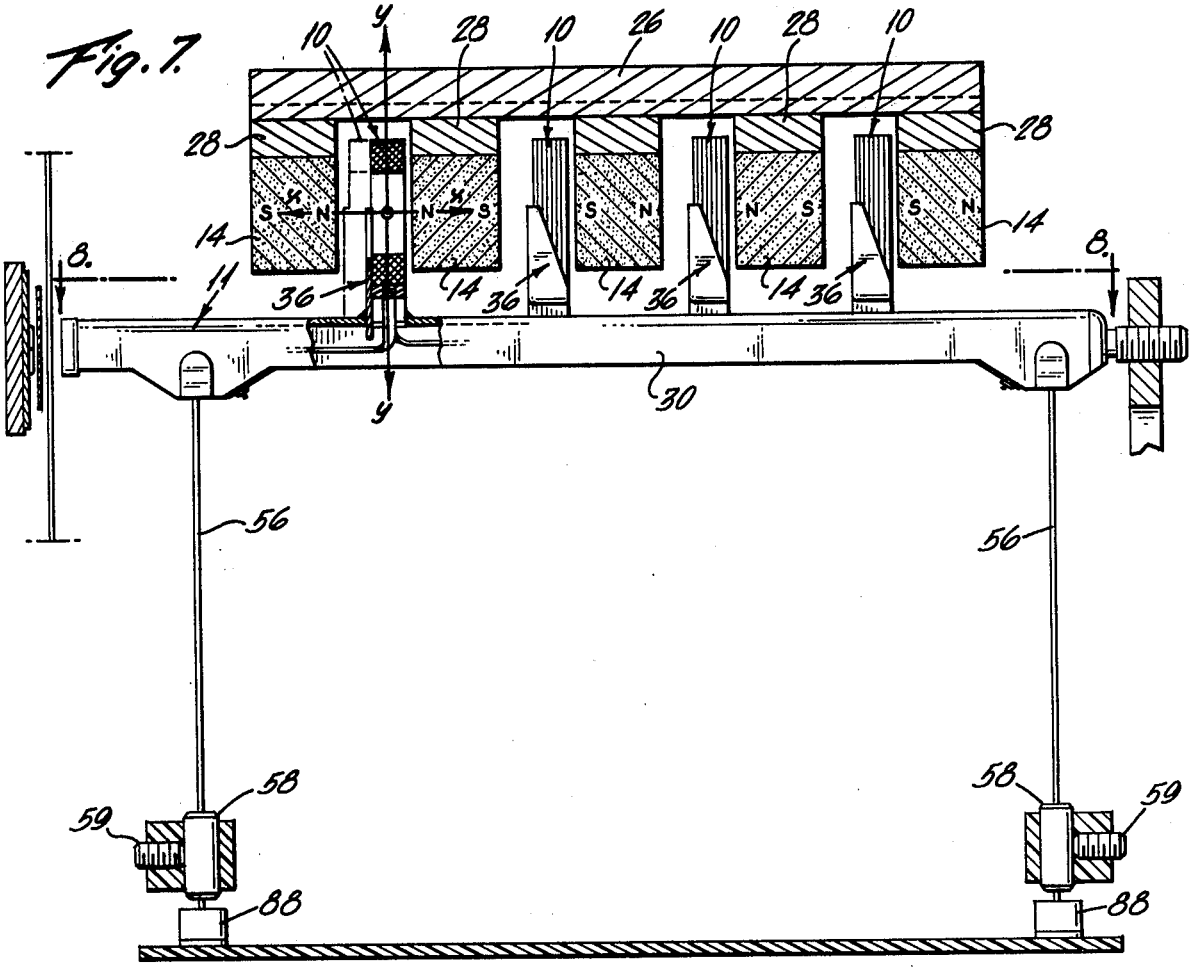
FIG. 7 is an elevational view of a modified construction according to the invention.
Figure 8:
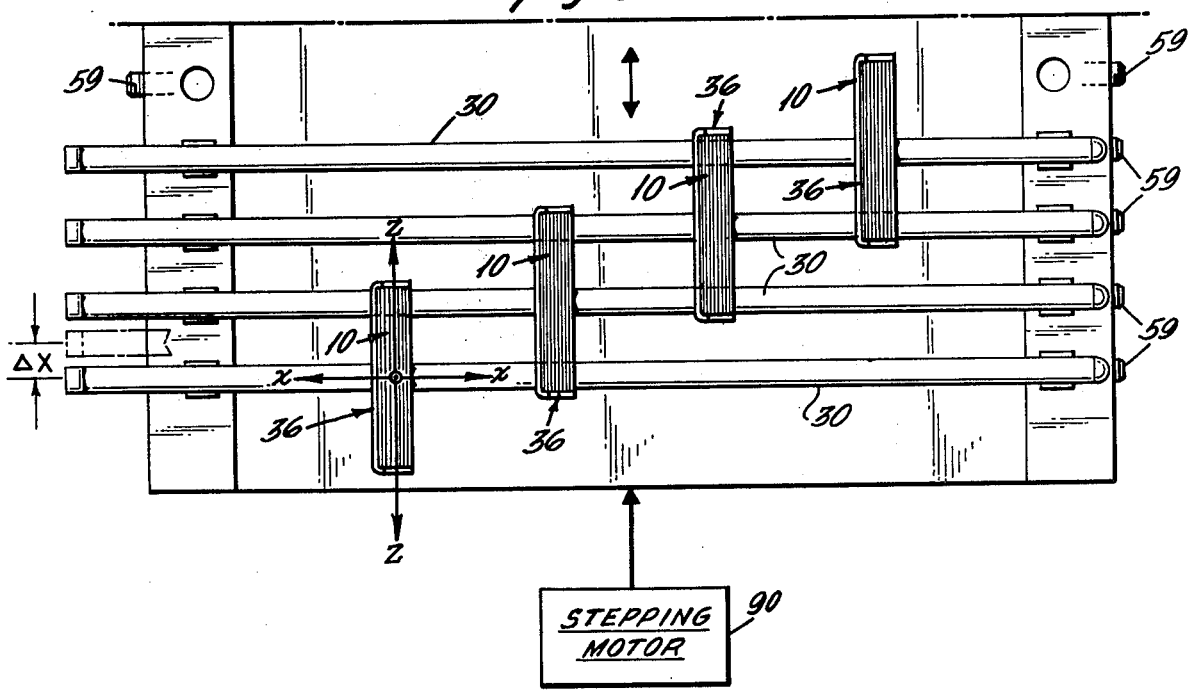
FIG. 8 is a plan view of the assembly of FIG. 7.

FIGS. 7 and 8 disclosed a modified form of line printer incorporating the principles of the invention. As can be seen in these figures, like reference numerals are applied to parts like those shown in FIGS. 5 and 6. Unlike the embodiment of FIGS. 5 and 6, only one bank or group of magnets is provided. Each of the hammers 11, serves two print positions. The hammers are provided with upwardly extending coils 10 and are adapted for movement from one print position to another within the gaps between the magnets 14. In carrying out the embodiment shown in FIGS. 7 and 8, a stepping device 90 which may comprise a cam and follower arrangement or a stepping motor is provided for the purpose of stepping the hammers relative to the magnets from one print position to the next. Although an arrangement is provided wherein each hammer serves two print positions, it should be understood that stepping means could be provided for stepping the hammers to three, or four or even more positions. The principles of the present invention render the invention well suited for applications wherein it is desired to have one hammer serve a plurality of print positions. Since the arrangement permits movement of the hammers relative to the magnetic means along the print line, only the relatively lightweight hammers need to move and this can be accomplished simply and at high speed with minimal concern for the forces of inertia. Another advantage of this arrangement is that the magnetic field intensity is the same at all print locations along the gaps so that a hammer which is stepped to different positions along the print line will always experience the same field effects.

I claim:

1. Magnetically actuated equipment for use in a printer or the like comprising first and second groups of permanent magnets, the magnets of said groups being respectively located in planes displaced from and substantially parallel to each other, said magnets of each group being further displaced with respect to one another so that gaps are formed between adjacent magnets in each group, the magnets of each group having a pair of opposed surfaces of opposite polarity and being positioned so that the surfaces of like polarity of adjacent magnets are presented toward one another across the gaps between the said adjacent magnets in each group, the surfaces defining a gap in the first group being in substantial alignment with the surfaces defining a gap in the second group and being of opposite polarity with respect to the surfaces in the second group, the like poles of the magnets in said groups being spaced in proximity to one another to form fields having field portions extending generally parallel to the surfaces defining the gaps and in opposite directions from a neutral axis within each gap, the proximity of the magnets producing an amplification of flux density in said field portions, generally planar conducting coils movably mounted within said gaps, an impact member associated with each coil for movement upon movement of said coil, means for independently electrically exciting each coil whereby pulsed magnetic fields are established when said coils are excited, each said coil being disposed within a gap with the coil axis extended transverse to said surfaces of like polarity, each said coil being wound upon a support of nonmagnetic material and having oppositely disposed legs located within the oppositely extending field portions.

2. Equipment according to claim 1 wherein the coils are located within said gaps with each coil plane being substantially parallel to surfaces of the gap within which it is located.

3. Equipment according to claim 1 wherein said permanent magnets are formed of a rare earth metal composition.

4. Equipment according to claim 1 further comprising impact members mounted in side-by-side relationship for movement in the space between said two planes, each of said coils being mounted on impact members for movement of the impact members in paths extending in a direction perpendicular to the coil plane.

* * * * *